US008746136B2

(12) United States Patent
Corbin

(10) Patent No.: US 8,746,136 B2
(45) Date of Patent: Jun. 10, 2014

(54) BANDING DEVICE

(75) Inventor: John Corbin, Neshanic Station, NJ (US)

(73) Assignee: Ben Clements & Sons, Inc., South Hackensack, NJ (US)

( * ) Notice: Subject to any disclaimer, the term of this patent is extended or adjusted under 35 U.S.C. 154(b) by 244 days.

(21) Appl. No.: 13/222,524

(22) Filed: Aug. 31, 2011

(65) Prior Publication Data

US 2012/0097053 A1 Apr. 26, 2012

Related U.S. Application Data

(60) Provisional application No. 61/406,485, filed on Oct. 25, 2010.

(51) Int. Cl.
*B65B 13/02* (2006.01)

(52) U.S. Cl.
USPC ..... 100/9; 53/390; 53/399; 53/435; 53/515; 53/583; 83/23; 83/54; 83/157; 83/781

(58) Field of Classification Search
CPC ..... B23D 36/0041; B65D 85/505; A01F 15/0715; B65B 13/022; B65B 27/10; B65B 67/06
USPC ..... 100/9; 53/390, 299, 435, 515, 583, 399; 83/23, 54, 157, 781
See application file for complete search history.

(56) References Cited

U.S. PATENT DOCUMENTS 4,149,357 A * 4/1979 Lucke ..... 53/585
4,480,536 A * 11/1984 Burns ..... 100/6
4,570,415 A * 2/1986 Centeno ..... 53/399
4,674,270 A * 6/1987 Tonus ..... 53/556
4,794,832 A * 1/1989 Trimble ..... 83/23
5,588,278 A * 12/1996 Wynn et al. ..... 53/399
7,198,593 B2 * 4/2007 Spatafora ..... 493/473
7,257,934 B2 8/2007 Swift et al.
7,565,789 B2 7/2009 Lucas et al.
2005/0172575 A1 * 8/2005 Swift et al. ..... 53/399
2009/0106909 A1 * 4/2009 Tyers ..... 7/118
2010/0089005 A1 * 4/2010 Swift et al. ..... 53/399

OTHER PUBLICATIONS

Search Report and Written Opinion of PCT/US2011/057467.

* cited by examiner

*Primary Examiner* — Shelley Self
*Assistant Examiner* — Onekki Jolly
(74) *Attorney, Agent, or Firm* — Edwards Wildman Palmer LLP; Howard M. Gitten

(57) ABSTRACT

A banding device includes a frame. A feeding assembly is mounted on the frame for feeding elastic tubing into the frame. A transfer assembly disposed within the frame includes transfer arm and fingers. The fingers receive the rubber tubing as fed. A cutting assembly is disposed between the transfer assembly and the feeding assembly for cutting the tubing into bands. The fingers of the transfer assembly move between a first closed position for receiving the band and a second open position for opening the band. The transfer arm is moveable between a first position for receiving the band and a second position for transferring the band. A banding assembly disposed at the second position receives the band from the transfer assembly. The banding assembly stretches the band and receives an item to be bundled within the band. The banding assembly releases the band about the bundle.

19 Claims, 8 Drawing Sheets

BANDING DEVICE

CROSS REFERENCE TO RELATED APPLICATIONS

This application claims the benefit of priority to U.S. Provisional Application No. 61/406,485 filed Oct. 25, 2010.

BACKGROUND OF THE INVENTION

This invention is directed to a device for bundling items by applying elastic bands onto objects to be held together or immobilized.

It is known in the art to bunch certain produce such as broccoli, celery, industrial products such as moldings and extrusions, or the like by applying elastic bands about several items. Exemplary prior art devices are represented by U.S. Pat. No. 7,257,934. In this device, at least one elastic tube is fed into the banding device. The tube is cut at predetermined lengths to form elastic bands. Once cut into bands, the bands fall onto fingers which separate to open the band to receive an article therein. Upon activation, the fingers release the band which surrounds the product forming the bundle. The product is then removed from the frame. The processes may be repeated in order to apply subsequent bands to the bundle.

The prior art device has been satisfactory, however, it suffers from the disadvantage that the same head which receives the band is the head which places the band on the bundle. Therefore, the device is limited to bundling only one band for each repeated cycle of the operation of the device, i.e. the object must be removed and reinserted for each additional band. Furthermore, it is difficult to consistently cut an elastic tube as it is fed. Elastic materials, stretch, are spongy and stick to themselves; making tubing hard to cut. The prior art often used two or more moving blades which tore at the tubing. However, such structure resulted in a jagged cut which was not aesthetically pleasing, an important factor when dealing with the sale of produce, and weakened the integrity of the band. Furthermore, because the blades moved against each other, the prior art knife required continuous oiling, or the use of powders, which could have the effect of contaminating the band and the food when bundled. Accordingly, a banding device which overcomes the shortcomings of the prior art is desired.

SUMMARY OF THE INVENTION

A banding device includes a frame. A feeding assembly is mounted on the frame for feeding elastic tubing into the frame. A transfer assembly disposed within the frame includes a transfer arm and fingers. The fingers receive the elastic tubing as fed. A cutting assembly is disposed between the transfer assembly and the feeding assembly for cutting predetermined lengths of tubing into bands. The fingers of the transfer assembly move between a first closed position for receiving the band and a second open position for opening the band. The transfer arm is moveable between a first position for receiving the band and a second position for transferring the band. A banding assembly disposed at the second position receives the band from the transfer assembly. The banding assembly stretches the band and is adapted to receive an item to be bundled within the band. The banding assembly includes a structure for releasing the band about the bundle.

In one preferred embodiment, the banding assembly is rotatable within the frame in which the banding assembly moves from a first position in which it is coaxial with the transfer arm when the transfer arm is disposed at the second position and a second position which is not coaxial with the receiving arm. Furthermore, the banding assembly may include a first set of banding mechanisms for receiving a first band thereon, and at least a second set of banding mechanisms for receiving at least a second band thereon. The transfer arm being controlled to extend into the banding assembly to selectively place a band on the first set of banding mechanisms and the second set of banding mechanisms. The first set of banding mechanisms and second set of banding mechanisms open the band so that the first band and the second band are coaxial with each other when opened.

At least one finger on the transfer arm of the transfer assembly is capable of moving between a first position and a second position to accommodate a variety of sizes of elastic tubing. Band length is controlled by a feed roller within the feed assembly. A drive shaft is affixed to a block mounted to the housing. The block is adjustably positioned on the housing to extend the drive length which increases the rotation of the drive shaft which in turn changes the rotation of the drive wheel to change the length of tubing being fed into the banding device. The cutting assembly includes a floating cutter block below the travel path of the band. A knife head disposed above the travel path of the band includes a finger which contacts and depresses the band during the cut and the knife finger pinching the band during the cutting process. Additionally, the transfer assembly is adjustable to extend the fingers into the banding assembly.

BRIEF DESCRIPTION OF THE DRAWINGS

The invention will be described in more detail by way of the following description in connection with the drawings in which.

DETAILED DESCRIPTION OF THE PREFERRED EMBODIMENTS

Figure 1:
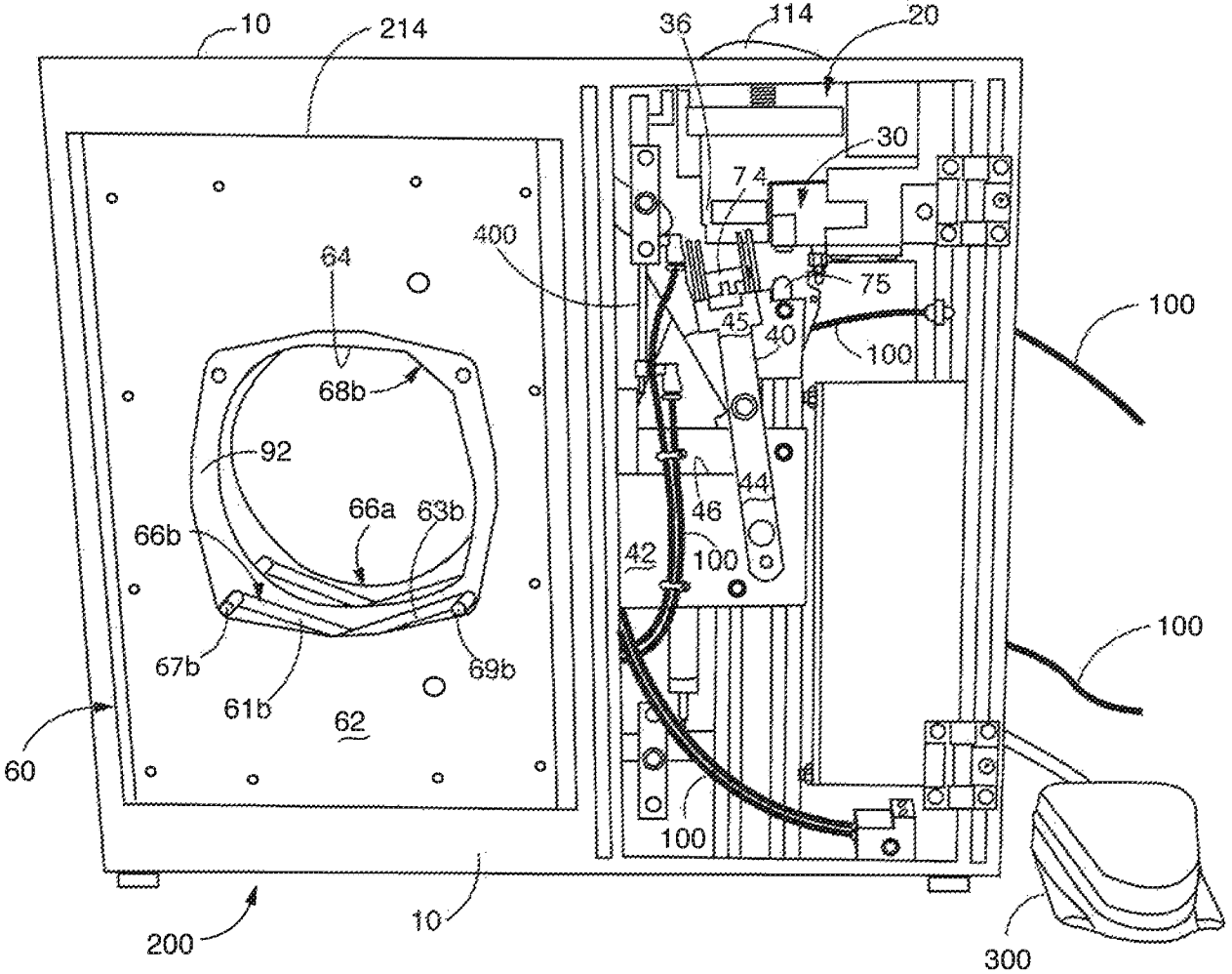
FIG. 1 is a plan view of a banding device constructed in accordance with the invention.
Figure 2:
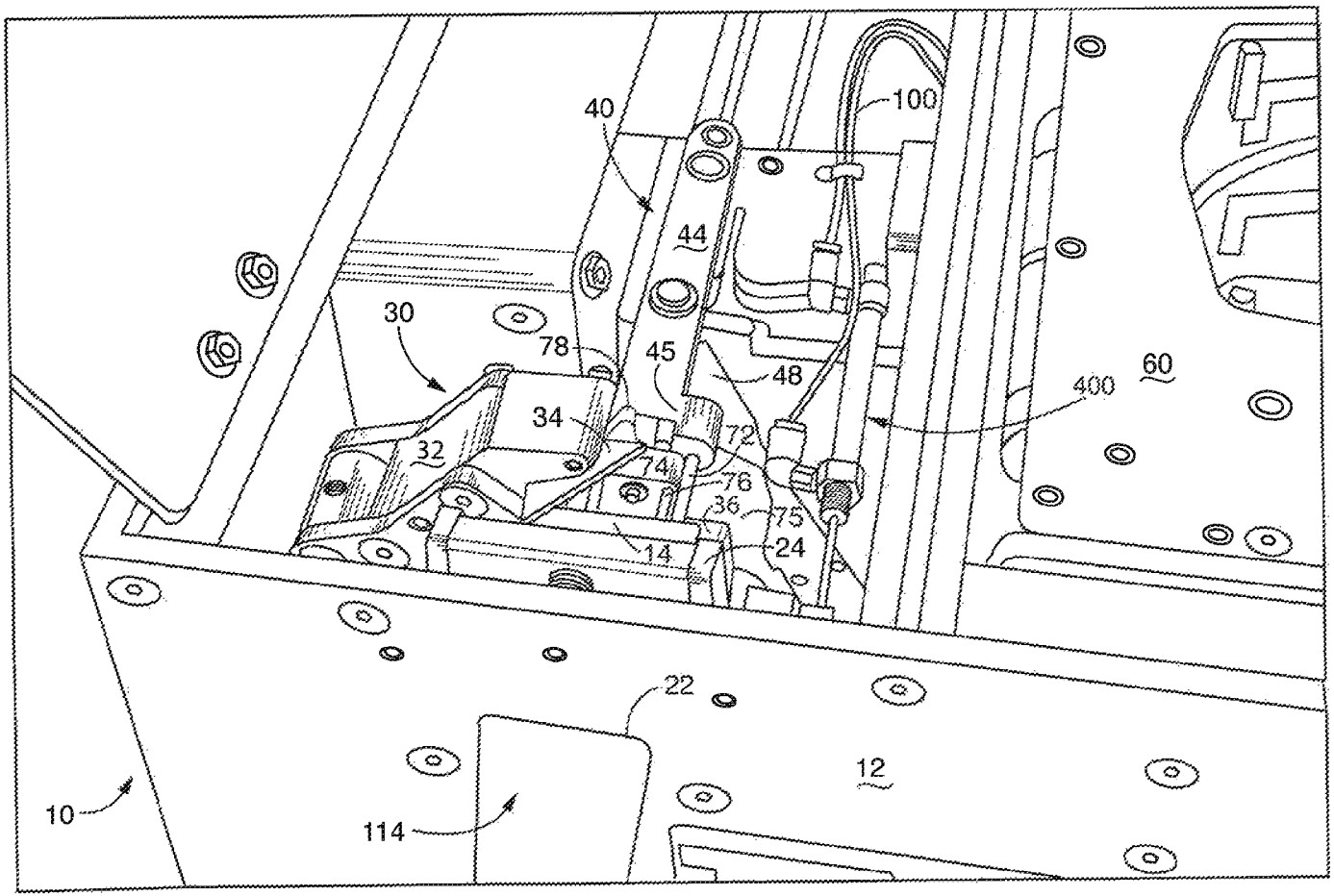
FIG. 2 is a perspective view of the feeding assembly, cutting assembly and transfer assembly constructed in accordance with the invention.

Reference is made to FIGS. 1 and 2 in which a banding device generally indicated as 200 includes a frame 10. A feeding assembly, generally indicated as 20, is disposed within frame 10 adjacent a wall 12 of frame 10. As more particularly seen in FIG. 2, an input port 22 is formed in wall 12 of frame 10 and is dimensioned to receive a raw stock of elastic tubing 114 which will then be formed into bands 14 as discussed below.

Portal 22 forms the entrance of a feed path. Feed assembly 20 includes a drive assembly generally indicated as 24 downstream of portal 22 for receiving tubing 114 and pulling tubing 114 through portal 22. In a preferred nonlimiting embodiment, drive assembly 24 is formed as a drive roller 26 and idler roller 28 (FIG. 6) which operate for a predetermined number of rotations (including less than 1) which are a function of time or speed, which, as is known in the art, corresponds to a predetermined feed length of tubing 114 into frame 10. Adjusting roller speed diameter or feed time results in different band widths.

Figure 6:
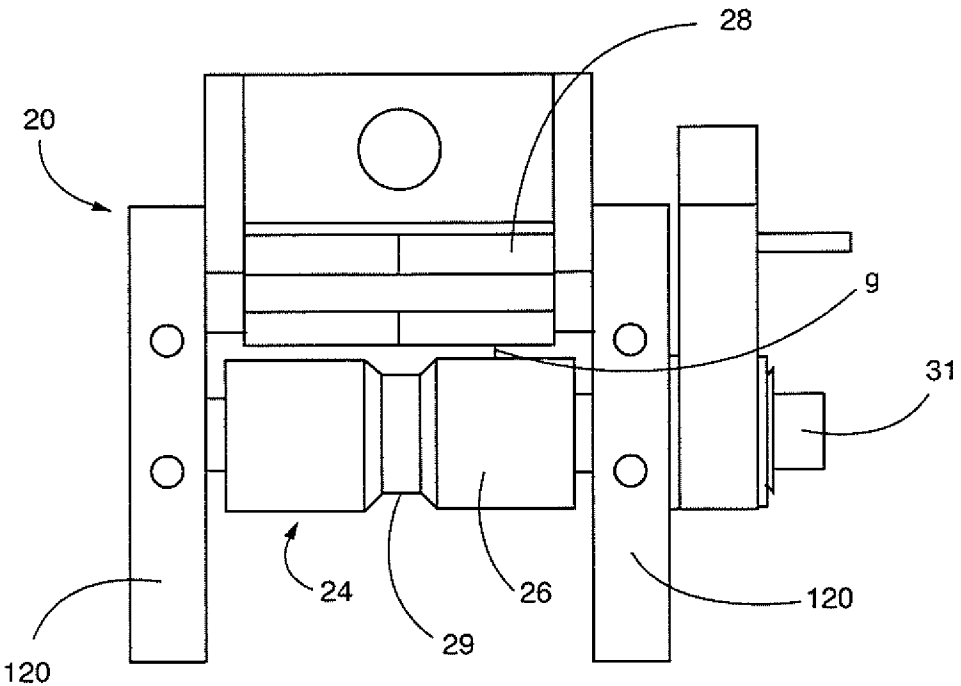
FIG. 6 is a front plan view of a feed assembly constructed in accordance with the inventions.

As more particularly seen in FIG. 6 a frame 120 rotatably supports drive roller 26 therein in spaced relationship from idle roller 28 to provide a gap g through which tube 114 is fed.

Idler roller 28 is spring biased to close against the drive roller 26. The spring is easily replaceable to allow this pinch force to be adjusted which in turn adjusts the force which the tube 114 is fed into the machine. This also allows the tube to be easily removed from the machine since a compression of the spring moves the idler roller 24 away from the drive roller 26.

During shipping the elongated tube 114 contains air. The compression of tube 114 as it is fed between rollers 24 and 26 traps the air within the tube forming a balloon. To provide a mechanism to release the air, a groove 29 is formed in at least one roller, drive roller 26 in this embodiment, which prevents tubing 114 from being pressed flat against itself which in turn prevents fully sealing tube 114 to allow air to escape during feeding. A drive shaft 31 mounted to frame 120 is mechanically coupled to drive roller 26 to rotate drive roller 26.

Although not described, it should be understood that as generally known in the art, banding devices operate in predetermined sequential time intervals as will be discussed below in greater detail under the control of either electronic or mechanical devices. Furthermore, in a preferred but nonlimiting embodiment, movement of each of the moving pieces discussed above is a function of hydraulic (including pneumatic) pressure provided by tubing 100 and pistons (see FIGS. 1, 9 by way of example) as generally known in the art. Alternatively, mechanical (gearing) and electrical timing and motors may be used to control the various assemblies.

In a preferred embodiment, feed assembly 20 also includes a feed block 27 (FIG. 3) having a general oval shape disposed downstream of rollers 26, 28 to flatten tube 114 as it is fed into frame 10 for formation into bands 14. Tubing 114 exits feed assembly 20 at an exit opening 29 of hollow feed block 27. When feeding tubing 114 through conventional feed rollers, air within the tubing gets trapped inflating upstream tubing, forming a blockage impeding further feedings. As discussed above, The inventive feed rollers have an uneven surface so that the tube does not entirely collapse upon itself during feeding, providing sufficient passageways for air to escape.

As discussed above, under timing control, rollers 26, 28 of feed assembly 20 operate at a predetermined rate for predetermined time to feed a sufficient length of elastic tube 14 from block 27 to create the desired length as a function of band speed and time of rotation, which are a function of stroke length.

Figure 3:
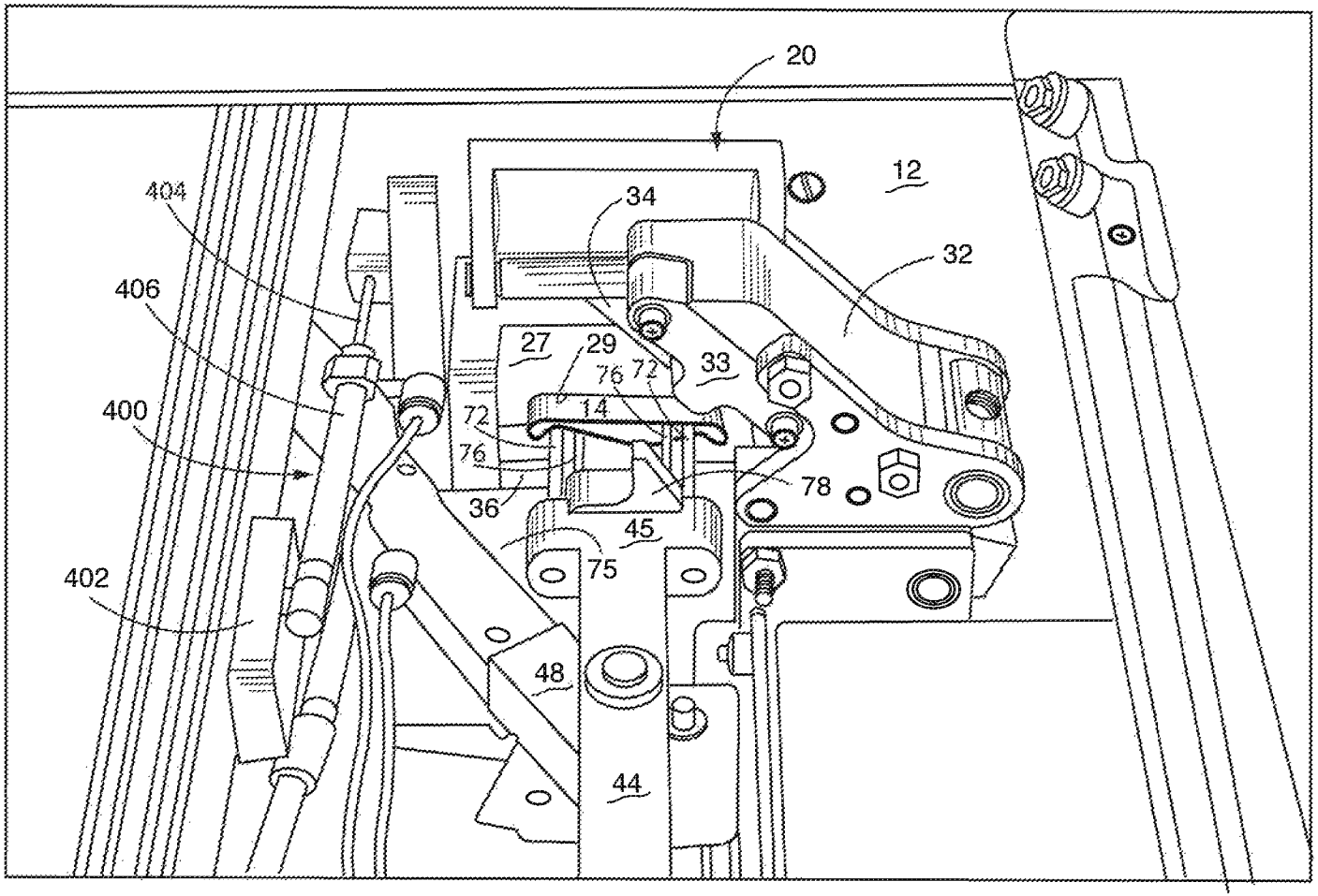
FIG. 3 is a perspective view of the transfer assembly, cutting assembly and feeding assembly constructed in accordance with the invention taken from an opposed orientation as FIG. 2.

A drive assembly, generally indicated as 400, drives drive roller 26. As seen in FIG. 3, drive assembly 400 includes a mounting block 402 affixed to frame 10. A drive piston 404 is mounted to block 402 and is coupled to and rotates drive shaft 31. Block 402 is adjustably mounted to frame 10 and is therefore movable to extend or decrease the drive length of piston 404. In this way, the drive time and resulting rotation of roller 26 is increased or decreased which allows for the production of bands of different widths.

A transfer assembly, generally indicated as 40, includes a camming block 42 disposed within frame 10 (see FIG. 1). A transfer arm 44 is moveably mounted on camming block 42 so as to pivot between a first position adjacent block 27 and a second position to cooperate with a banding assembly 60. A cam follower 244 (FIG. 8) extends from transfer arm 44 within a camming path 46 of camming block 42. A drive arm 48 operatively coupled to transfer arm 44 causes transfer arm 44 to move along camming path 46.

A pick up assembly 70 is mounted on a free end of transfer arm 44. Pick up assembly 70 includes a pair of fixed fingers 72 extending from a block 45 of transfer arm 44. A rotation block 74 is rotatably mounted to block 45. A second pair of fingers 76 extend from rotation block 74. A stop 78 extends from rotation block 74.

Figure 4:
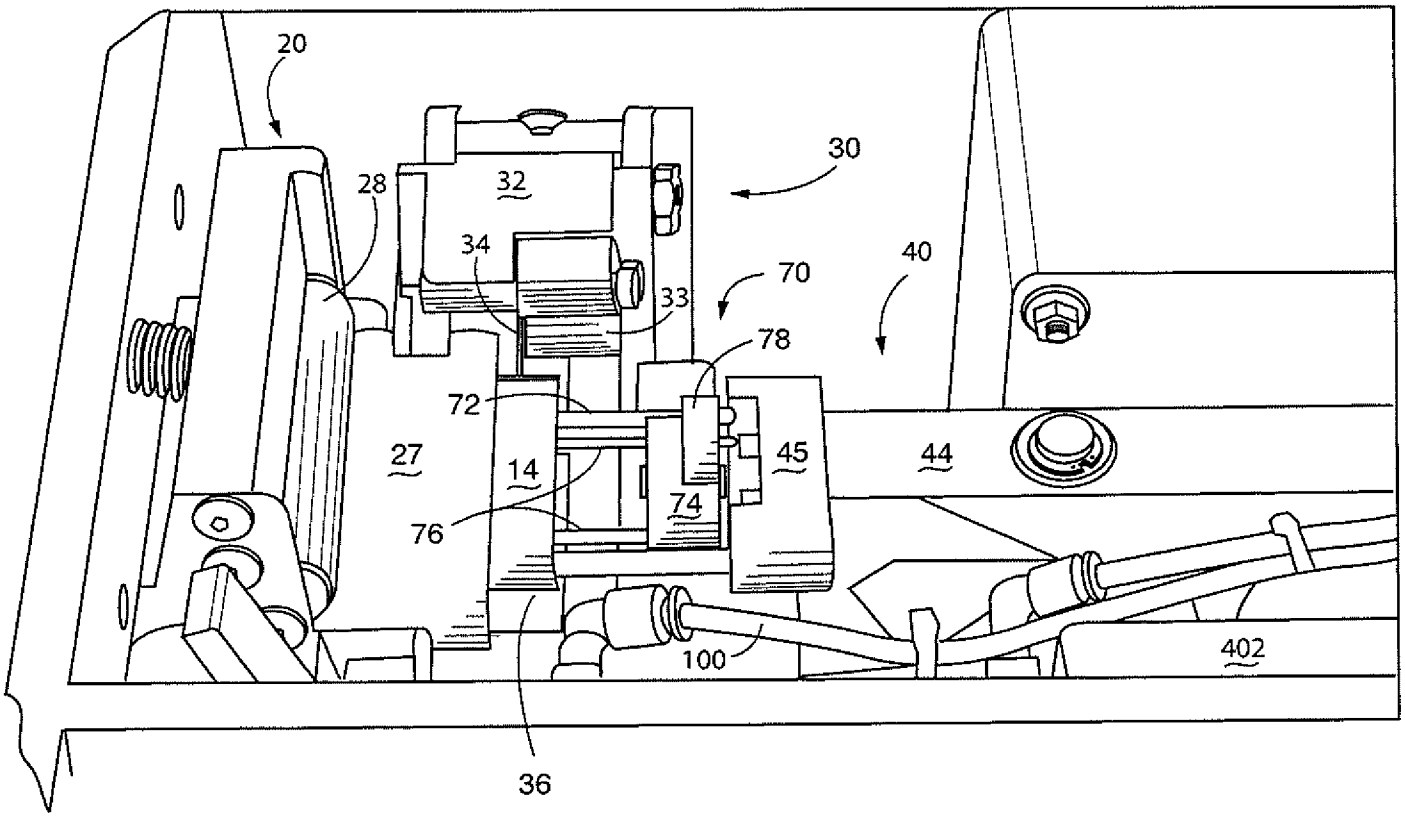
FIG. 4 is a perspective view of the transfer assembly, cutting assembly, and feeding assembly constructed in accordance with the invention, from yet another orientation.

When transfer arm 44 is disposed in the first position, pairs of fingers 72, 76 lie substantially in the same plane. Pairs of fingers 72, 76 are dimensioned and disposed to receive tubing 114 thereon as it is fed from feed assembly 20 (FIG. 3, FIG. 4). Furthermore, finger pair 76 are dimensioned so as not to extend fully to block 27. There is a gap between exit 29 of block 27 and the end of each of finger pairs 72, 76.

Block 74 is rotatable relative to block 45 so that the fingers 76 move from a first closed position in which fingers 76 are substantially coplanar with fingers 72 to an open position in which fingers 76 form the corners of a box with fingers 72. Block 74 rotates until stop 78 contacts one of fingers 72 which prevents further rotation beyond the open position.

Block 74 may be controlled either by a spring biasing it to open or close, or powered by pneumatic power or any other mechanical or electrically motorized mechanism which provides force for head 74 to rotate. Head 74 rotates as transfer arm 44 moves from the first position to the second position. In this way, any band mounted on fingers 72, 76 is opened, i.e. expanded about the fingers as fingers 76 rotate.

In the preferred embodiment, pick up assembly 70 includes a camming surface 75 cooperatively engaging block 74. Block 74 is biased in the open position by a torsion spring (not shown). As transfer arm 44 moves towards the first position, camming block 75 comes in contact with block 74 to rotate block 74 into the closed position against the tension of the spring. As transfer arm 44 moves towards a second position, away from camming block 75, block 74 is allowed to rotate under the force of the torsion spring to the open position.

Figure 7:
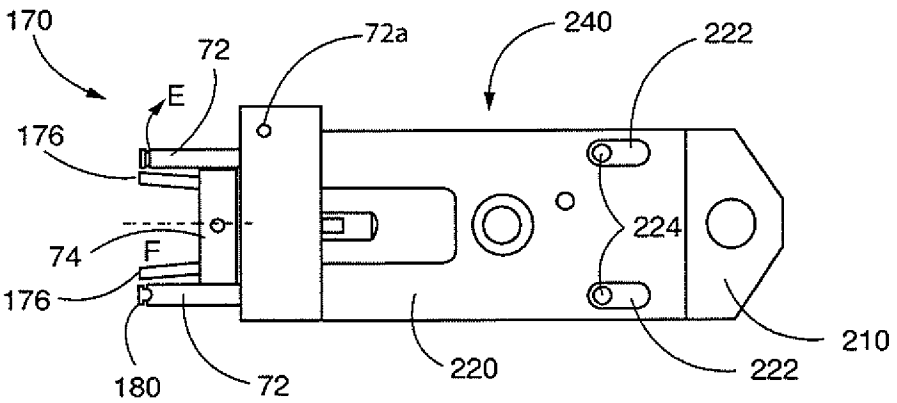
FIG. 7 is a top plan view of a transfer assembly constructed in accordance with a second embodiment of the invention.
Figure 8:
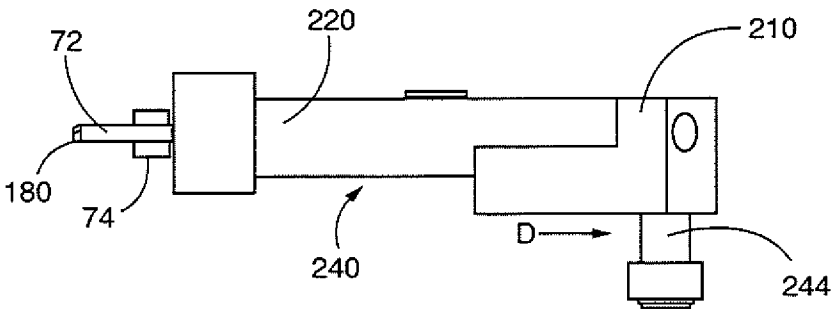
FIG. 8 is a side elevation view of the transfer assembly of FIG. 7.

As discussed above, rubber tubing 114 utilized by the present invention has characteristics of being both spongy and elastic. Therefore, the bands 14 tend to creep or move relative to any holding structure such as the fingers or even the cutting assembly to be discussed below. Furthermore, the present invention accommodates a variety of sizes of bands 14 both in width and diameter. To better accommodate a variety of different sized bands 14 in a preferred embodiment of the invention as shown in FIGS. 7 and 8, the transfer assembly is adjustable. Reference is now made to a transfer assembly, generally indicated as 240, which is adjustable in length to accommodate a variety of width of rubberbands 14 and includes at least one movable finger 72 for accommodating a variety of diameters of band 14.

Specifically, transfer assembly 240 includes a base 210 and a transfer block 220. As with transfer assembly 40, a rotation block 74 is mounted at a distal end of transfer block 220. Fingers 176 are mounted to rotation block 74. A finger pair 72 extends from block 220.

Block 220 is formed with slits 222 therein. Fasteners 224 such as screws, pegs or the like fit within slits 222 and fasten block 220 to base 210. By loosening the screws 224, base 210 may be moved relative to block 220 in the direction of arrow D to extend overall length of transfer assembly 240 to accommodate placing thinner widths of band on the banding assembly. Fastening of fasteners 224 along positions within slits 222 holds base 210 in a variety of positions relative to block 220 to accommodate a variety of widths of band.

Base 210 includes a cam follower 244. In this way, base 210, and in turn transfer assembly 240, moves along cam path 46 as discussed above.

As is discussed below, during cutting each tube 114 as cut may have different tolerances and therefore may be slightly off in diameter from tube 114 to tube 114. As during the cutting process, at least the center of the tube 114 is compressed as will be discussed below. As a result, in a preferred embodiment secondary fingers 176, are angled relative to transfer block 74 to better catch the uncompressed wings of the band. Pins 176 are angled about 10-15 degrees from being coaxial with the axes of rotation F of rotation block 74. Furthermore, at least one of fingers 72 is spring biased to move in the direction of arrow E about a pivot 72*a* in the direction away from the axis rotation F. In this way, at least one of finger 72 is adjustable to the variety of diameters and widths of cut bands 14 being picked up at the cutting assembly 30 so it is movable to adjust to diameter with which it is faced.

As assembly 240 rotates into position from the cutting assembly to banding assembly 60. One finger 72 by way of example, is a leading finger along the movement and a second finger 72 is a trailing finger. Because of the restorative property of the band, it will creep along fingers. To prevent the band 14 from creeping beyond fingers 72, 72, a notch 180 is formed in each finger towards the distal end (the end away from block 220).

A cutting assembly 30 is disposed along the feed path between block 26 and the distal end of pairs of fingers 72, 76. Cutting assembly 30 includes a rotatable cutting head 32 and a blade 34 disposed within cutting head 32 in facing relationship with the feed path of tubing 114 to make a cut across tubing 114.

Cutting head 32 is rotatably mounted within frame 10 so as to move between a first position above the feed path (providing clearance for feeding of tube 114) and a second position in which the leading edge of cutting blade 34 has passed below the plane of finger pairs 72, 76 to a cutting block 36, i.e. below the feed path. In a preferred embodiment, blade 34 is a non-serrated blade.

As discussed above, it is known in the art that the movement of cutting head 32 is under the control of timing mechanisms and may be powered either by fluid pressure (preferably air pressure), mechanical gearing type devices, or an electric motor.

Because tubing 114 is an elastic material such as preferably rubber, it is difficult to consistently cleanly cut. In the prior art devices, as a result of using two or more moving blades, or allowing for too much play in the knife or in the tube material, this stretches the material resulting in bands 14 cut with jagged edges in the band. This is not aesthetically pleasing and therefore, makes it a disadvantage in selling produce. It may also weaken the bands.

To overcome this issue, in a preferred embodiment blade 34 is maintained in contact with cutting block 36 for a predetermined dwell time reducing stretching of the material during cutting. The cycle for the knife is between 0.3 seconds and one second; preferably 0.5 seconds with a dwell time (blade 34 pinning the tube against cutting block 36 sufficient to prevent stretching of tube 114 during cutting). This results in straighter more consistent cuts. During cutting, a projection 33 extend from cutting head 32, presses tubing 114 in the proper orientation for cutting as cutting head 32 rotates into the cutting position. Also because a single blade 34 is used, there is no need for oiling the blade.

Furthermore, if a narrow band 14 is being cut, band 14 covers only the tips of the fingers 72, 76 at the cut. Because of the elastic needs of the bands, during cutting, blade 34 compresses band 14 against itself and against cutting block 36. Because of this compression, the band is being pulled towards the cut point so that narrow bands can be pulled over and off of fingers 72, 76 during cutting. Projection 33 holds the about to be cut tube 114 in place preventing the band 14 from falling off fingers 72, 76. Additionally, the tips of fingers 72, 76 may be made with an angled surface, up to forty-five degrees to facilitate band 114 staying on fingers 72, 76.

Furthermore, because of any rollover cut band 14 may move into and get trapped into the uncut portion of tubing 114 which opens up upon being cut. A finger may be affixed to cutting head 32 on the feed side of blade 34 to hold the uncut tubing 114 down during cutting to prevent tubing 114 from opening.

Furthermore, because of the inconsistencies between different tubings 114, the depth of the pivot of the cutting head 30, and in turn cutting blade 34 can change over time and from sample to sample of tubing 114. This can affect the cut. To accommodate for this, cutting block 36 floats within frame 10, in other words, is free to slightly rotate about an axis substantially perpendicular with the plane of blade 34 so as to self adjust to square itself relative to blade 34. In this way, the orientation between blade 34 and cutting block 36 remains substantially consistent and parallel the cut.

It should be noted that cutting head 30 pivots in the preferred, but non limiting embodiment. However, the cutting may also take the form of a linear guillotine type mechanism.

Banding assembly 60 includes a sub-frame 62 rotatably mounted within frame 10 about a pivot 214. Subframe 62 is formed with an opening 64 extending through frame 62. A first banding mechanism includes finger mechanisms 66*b*, 68*b* which are disposed within subframe 62 adjacent opening 64. At least a second pair of finger mechanism 66*a*, 68*a* (not shown) are disposed within subframe 62 about opening 64 and operate coaxial with, and in a similar manner, to finger mechanism 66*b*, 68*b*.

Figure 5:
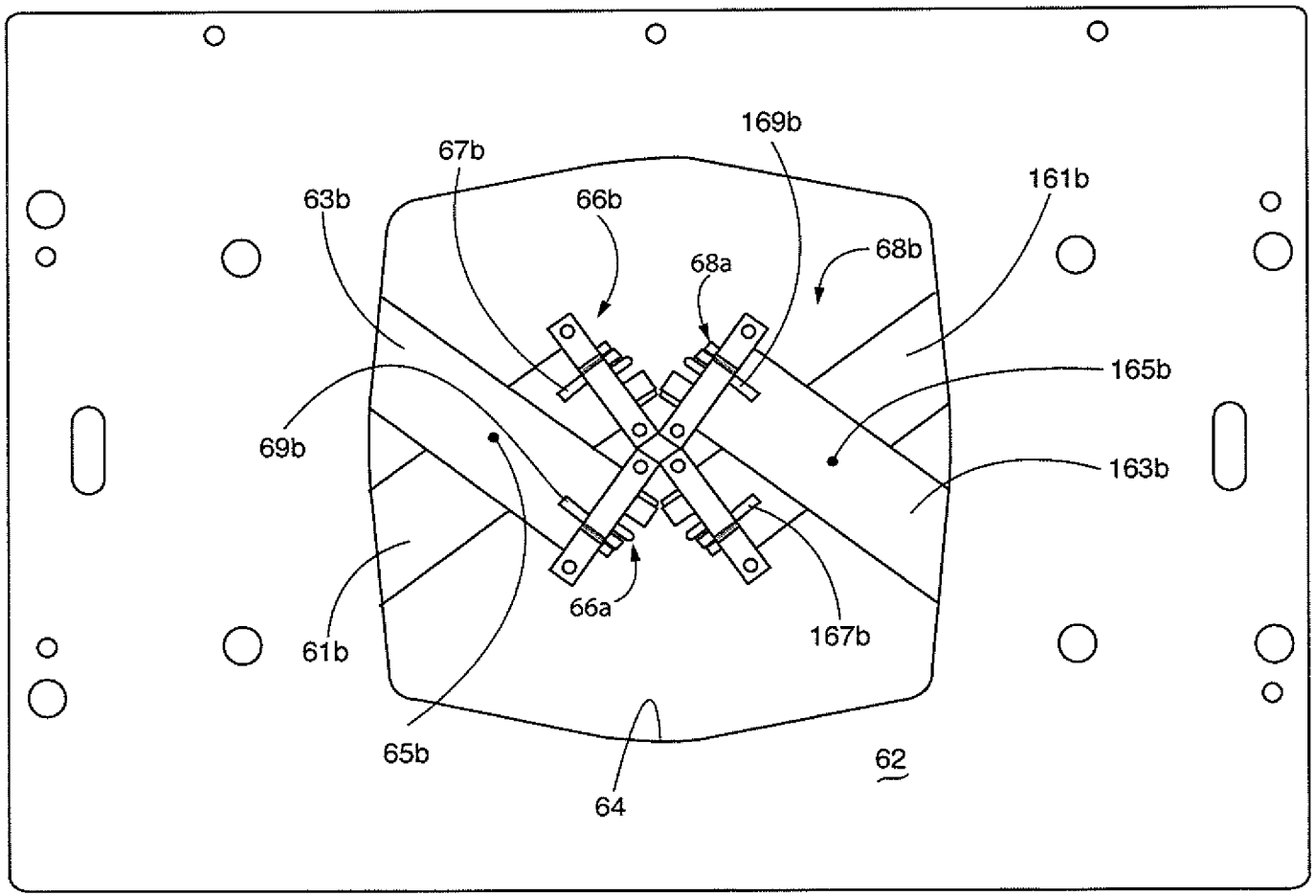
FIG. 5 is a schematic drawing of the plan view of the bundling assembly constructed in accordance with one embodiment of the invention.

Reference is now made to FIG. 5 in which the structure of a first banding mechanism having finger mechanisms 66*b*, 68*b* are shown in detail. The structure for finger mechanisms 66*a*, 68*a* are identical to those of 66*b*, 68*b* and the structure of finger mechanism 66*b* is substantially the mirror image of finger mechanism 68*b*. Finger mechanisms 66*b*, 68*b* work in tandem to receive a band from transfer assembly 40 and place the band about the bundle as will be described below.

To facilitate description of the system, the operation and structure of only first banding mechanism having finger mechanisms 66*b*, 68*b* will be discussed as exemplary of the second banding mechanism and all other finger mechanisms within the additional banding mechanisms. Finger mechanism 66*b* has a scissor-like construction, a first arm 61*b* is mounted to a support plate 92 (FIG. 1) within subframe 62 at a first end. At a second opposed end, a peg 67*b* acting as a finger extends from arm 61*b*. A second arm 63*b* is mounted to support plate 92 and has a peg 69*b* extending in a direction parallel to finger peg 67*b*. Arm 61*b* is connected to arm 63*b* by pivot 65*b* so that movement under hydraulic control, mechanical (gearing) control or electric motor causes each of arms 61*b*, 63*b* to pivot about pivot 65*b*. As will be recognized by those skilled in the art such a structure, will bring finger pegs 67*b*, 69*b* closer to or away from each other as a function of the movement of the arms.

Similarly, finger mechanism 68*b* includes a first arm 161*b* anchored at a first end on support plate 92. A peg 167*b* extends from arm 161*b* parallel to peg 67*b*. A second arm 163*b* is anchored on subplate 92 and includes a peg member 169*b* extending from a surface of arm 163*b* in a direction to be parallel and coplanar with any one of peg members 167*b*, 67*b*, 69*b*. Arm 161*b* is coupled to arm 163*b* by a pivot 165*b* which enables scissoring action.

It should be noted that in a preferred embodiment, finger mechanism 68*b* is in facing relationship across opening 64 from finger mechanism 66*b*. Peg 67*b*, 69*b*, 167*b* and 169*b* are fingers which are adapted to receive a band from transfer assembly 40 as will be discussed in greater detail below. As anchors 94 move together, pegs 67*b*, 69*b* by way of example, move into opening 64 and move towards each other. A similar action is performed by finger mechanism 68*b* such that movement of finger mechanisms 66*b*, 68*b* from a first position in which they are within subframe 62 (FIG. 1) to a second position in which the pegs are disposed within opening 64 shown in FIG. 5. In the second position, finger mechanisms 66*b*, 68*b* are ready for receiving a band from transfer assembly 40 about pegs 67*b*, 69*b*, 167*b* and 169*b*.

Finger pegs 67*b*, 69*b*, 167*b* and 169*b* are mounted on respective arms 61*b*, 63*b*, 161*b*, 163*b* to selectively release bands opened thereon. This can be done by sliding finger pegs 67*a*, 67*b*, 167*a*, 167*b* through respective arms 61*b*, 63*b*, 161*b* and 163*b* to release the band. The respective finger pegs may also rotate in from the band to release, fold down relative to the arms, or any other mechanism for moving from a position in which finger pegs prevent return of the band to its normal (unstretched) state and a second position where the finger pegs hold the band in an open position.

Both the first banding mechanism and the second banding mechanism open bands coaxially to opening 64. In this way the subframe include a first banding mechanism for receiving a first band 14 thereon and at least second banding mechanism for receiving at least a second band 14 thereon. If an item to be bundled is placed within opening 64 and the bands are released, two bands 14 are simultaneously attached to the bundle without having to reinsert the bundle within opening 14 as with the prior art.

Figure 9:
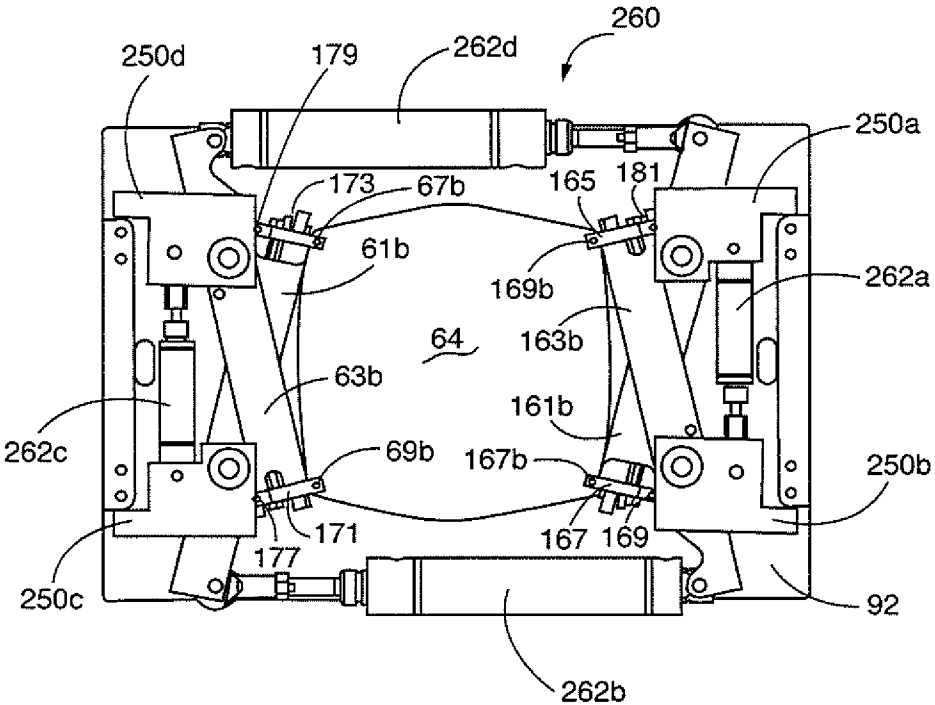
FIG. 9 is a top plan view of the banding assembly constructed in accordance with another embodiment of the invention.

Reference is now made to FIG. 9 which is a top plan view of a banding assembly, generally indicated as 260, constructed in accordance with another embodiment of the invention in which frame 62 is not shown. The primary difference between banding assembly 60 and banding assembly 260 is the change from a scissor construction to an embodiment in which the arms are independently driven. Furthermore, a camming mechanism for releasing the rubberband is also shown in greater detail. Like numbers are utilized to indicate like structure.

Each arm 61*b*, 63*b*, 161*b* and 163*b* is connected to a respective hydraulic piston drive, a piston rod in a non limiting embodiment, 262*b*, 262*c*, 262*d*, and 262*a*. In this way, each arm is driven independently of another. Lengthening of the piston rod during the drive stroke causes a respective arm to enter space 64 while shortening of the drive arm in the return stroke retracts the respective arms stretching a band 14 on the respective finger pegs.

Four camming blocks 250*a*, 250*b*, 250*c* and 250*d* are each anchored to support plate 92 within frames 62. Arm 163*b* includes a rotating block 165 upon which peg 169*b* is mounted. A second peg 181 is mounted on a catch block of rotating block 165 which keeps finger block 165 from rotating/releasing until camming blocks 250 actuate the catch block so that as hydraulic piston 262*b* moves arm 163*b*, by way of example, into an open position, i.e., out of opening 64, pin 181 is adjacent camming block 250*a*. Pin 181 does not contact camming blocks 250 when cylinder 262*b* actuates to spread arm 163*b*. Pin 181 only comes adjacent to camming block 250 at this time. To release the band 14, cylinder 262*a* actuates, camming block 250 then rotates, contacting pin 181 fully, which in turn releases the catch that is holding finger block 165. Tension in band 14 rotates block 165 inwards allowing band 14 to slide off the finger.

Similarly, arm 161*b* includes a rotating head 167 and camming pin 169 which when contacting camming block 250*b* releases rotating head 167 so that band tension move peg 167*b* to release band 14 retained thereby. Similarly camming pin 177 will come in contact with a camming block 250*c* to release rotating head 171 mounted on arm 63*b* so that peg 69*b* moves to release rubberband 14. Lastly, a rotating head 173 affixed to arm 61*b* includes a camming pin 179 which will contact a camming block 250*d* which will release rotating head 173 allowing peg 67*b* to move to release band 14 held thereby.

During operation, banding device 200 operates in accordance with a cycle. In response to a start command, from either an electronic or hydraulic input, feeder assembly 20 feeds a predetermined length of tube 14 into frame 10 such that at least a portion of tube 14 is disposed about pick up assembly 70 with pairs of fingers 76, 72 which are in a substantially coplanar position, extending into tubing 114 feeding assembly 20 stops feeding.

It should be noted that the banding assembly 60 may operate a independently of the transfer assembly. In other words the banding assembly can operate as a stand alone structure.

Cutting head 32 then rotates to move cutting blade 34 through tubing 114 until it comes into contact with cutting block 36 to create a band 14. Cutting blade 34 stays in contact with cutting block 36 for a predetermined amount of time to ensure a clean cut.

At the end of the predetermined time period, drive arm 48 moves transfer arm 44 along camming block 42. Transfer arm 44 moves from a first position coaxial with the feed path of tubing 114 to a second position in which pairs of fingers 72, 76 are in facing relationship with subframe 62. As transfer arm 44 moves from the first position to the second position, block 74 rotates from a first position to a second position rotating fingers 76 relative to fingers 72 to form points of a square opening the band 14 so that the band 14 is opened by the time transfer arm 44 reaches the second position. In a preferred embodiment, block 74 rotates through about 90 degrees, however, any amount of rotation which sufficiently opens a band 14 to be received on the finger pegs 67*b*, 69*b*, 167*b*, 169*b* of the finger mechanism 66*b*, 68*b* is sufficient for operation of the invention.

Subframe 62 rotates from a first position, in which the axis of opening 64 is substantially perpendicular to the axis of arm 44, to a second position in which the axis through opening 64 is substantially coaxial with the axis of arm 44 when in the second position. Finger mechanisms 66*b*, 68*b* scissor to the second position in which pegs 67*b*, 69*b*, 167*b*, 169*b* are disposed within opening 64 as subframe 62 rotates. Furthermore, pegs 67*b*, 69*b*, 167*b*, 169*b* are sufficiently close together to fit within the circumference of the opening of the band when it is held by pick up assembly 70 in the second position.

Transfer arm 44, when in the second position, is moved by camming groove 46 into opening 64 sufficient to enable pegs

67*b*, 69*b*, 167*b*, 169*b* to be received within band 14. The finger mechanism 66*b*, 68*b* are then returned to the first position so that pegs 67*b*, 69*b*, 167*b*, 169*b* all move away from each other opening the band to a circumference greater than the circumference of the open pairs of fingers 72, 76 removing the band from transfer assembly 40. Transfer assembly 40 then returns to the first position to receive the next fed amount of tubing 114.

In sequence, transfer arm 44 returns to its start position and then subcabinet 62 rotates to return to the first position so that space 64 is accessible for insertion of items to be bundled. It should be readily understood that banding assembly 60 need only open the band from a first circumference greater than the circumference of the band 14 held on pick up assembly 70 to a second circumference greater than the circumference of the item to be bundled. In a preferred embodiment, band 64 is opened to substantially the circumference of opening 64 to accommodate a variety of different items without need for adjustment between items. Once the item is inserted through space 64, and in turn, the open band, a trigger mechanism either a sensor or a switch such as, in a preferred embodiment, foot pedal switch 300 causes fingers 67*b*, 69*b*, 167*a*, 169*b* to release the band 14 so that it collapses about the item to be bundled. The banded item is then removed.

As discussed above, it is often desirable to have two or more bands 14 about the bundle. Previously, this was done by inserting the item a first time to be banded by a first band, repeating the entire cycle, and inserting the item to be bundled a second time. However, in accordance with the present invention, as subframe 62 rotates from the first position to a second position to receive a band 14 from transfer arm 44, both first finger mechanisms 66*a*, 68*a* and second finger mechanism 66*b*, 68*b* move from the first position to the second position. A switch may be used to control device 200 to provide an input to a control device such as a PLC to switch between a single band and multi-band mode.

In this embodiment, transfer arm 44 transfers a first band to second finger mechanism 66*b*, 68*b*, which are closest within subframe 62 to pick up assembly 70 when transfer arm 44 is in the first position. Transfer arm 44 only extends into opening 64 a sufficient distance to deposit a band on peg 67*b*, 167*b*, 69*b*, 169*b*. Second finger mechanism 66*b*, 68*b* then open exposing first finger mechanism 66*a*, 68*a* to transfer arm 44. Transfer arm 44 returns to the first position and receives a second band in a cycle substantially identical to creation of the first band 14, returns to the second position, and extends further into opening 64 in order to deposit the band on first finger mechanisms 66*a*, 68*a*.

Transfer arm 44 is prevented from moving beyond second finger mechanisms 66*b*, 68*b* when second finger mechanisms 66*b*, 68*b* are in the second position, i.e. the position for receiving the band. This may be done in a number of ways, either with presence sensors, motion detectors, with breaks along camming surface 46, or control of motion of power arm 48 under a computerized control.

Once both bands are on the two or more banding mechanisms (fingers 66*a*, 68*a*, 66*b*, 68*b*) the item to be bundled is inserted through opening 64 and switch 300 is activated to release both rubber bands. The bands are then released one at a time, or together as a function of the input from the PLC control or switch as discussed above.

As a result of utilizing a pick up assembly, a transfer arm and an independent banding assembly, it becomes possible to bundle objects with two or more rubber bands without the need to reinsert the item being bundled. Furthermore, by utilizing a knife having a straight edge in combination with a cutting block and a predetermined dwell time, straighter, more consistent cuts are provided without the need for continued lubrication of the blade improving the aesthetics and the sanitation of the bundled products, particularly edible products. By utilizing a transfer arm, which moves from a first position to a second position, and a rotatable bundling assembly, the overall structure of the banding device becomes more compact requiring less real estate in a packaging facility. It should be noted, that although the device was described in connection with operations on tubing, the tubing does not constitute a part of the invention. By utilizing a transfer arm which hands off the band to the banding assembly, the handling of the cut band during the entire machine cycle is always under control.

Thus, while there have been shown, described and pointed out, novel features of the present invention as applied to preferred embodiments thereof, it will be understood that various omissions and substitutions and change in the form and detail are contemplated to the disclosed invention which may be made by those skilled in the art without departing from the spirit and scope of the invention. It is the intention, therefore, to be limited only as indicated by the scope of the claims appended hereto. It is also to be understood that the following claims are intended to cover all the generic and specific features of the invention herein described and all statements of the scope of the invention, which as a matter of language, might be said to fall there between.

What is claimed is:

1. A banding device comprising:

a frame;

a feeding assembly for feeding an elastic tubing into the frame;

a transfer assembly including a body is disposed within the frame, the transfer assembly having a pick up assembly, the pick up assembly having two or more fingers, the fingers adapted to receive the elastic tubing as fed from the feeding assembly; and a cutting assembly disposed between the transfer assembly and feeding assembly for cutting predetermined lengths of tubing into at least a band, at least one of the two or more fingers moveable between a first closed position for receiving the band and second open position for opening the band, and the body being moveable between a first position for receiving the band and a second position for transferring the band to a banding assembly, and the banding assembly for receiving the band from the transfer assembly at the second position and further opening the band, and adapted to receive an item to be bundled, and releasing the band about the item;

wherein the cutting assembly includes a cutting blade rotatably mounted within the frame and a cutting block, the tubing traveling along a feed path, the cutting blade moving from a first position to a second position through the feed path to contact the cutting block and the cutting assembly has a cutting head, the cutting heading including a projection for pressing a tubing in the feed path against the cutting block.

2. The banding device of claim 1, wherein the blade maintains contact with the cutting block for a predetermined time period.

3. A banding device comprising: a frame; a feeding assembly for feeding an elastic tubing into the frame; a transfer assembly including a body is disposed within the frame, the transfer assembly having a pick up assembly, the pick up assembly having two or more fingers, the fingers adapted to receive the elastic tubing as fed from the feeding assembly; a cutting assembly disposed between the transfer assembly and feeding assembly for cutting predetermined lengths of tubing into at least a band, at least one of the two or more fingers moveable between a first closed position for receiving the band and second open position for opening the band, and the body being moveable between a first position for receiving the band and a second position for transferring the band to a banding assembly, and the banding assembly for receiving the band from the transfer assembly at the second position and further opening the band, and adapted to receive an item to be bundled, and releasing the band about the item; and the cutting assembly includes a cutting blade and a cutting block, the cutting block being disposed within the frame to rotate relative to the frame.

4. The banding device of claim 3, wherein the body is a transfer arm movable between a first position and second position and the pick up assembly includes a rotation block, at least one of the two or more fingers movable between the first closed position and second open position being mounted on the rotation block.

5. The banding device of claim 3, wherein the feeding assembly includes a drive roller, the drive roller having an uneven surface.

6. The banding device of claim 3, wherein the feeding assembly includes a drive roller, and further comprising a drive shaft for rotating the drive roller, the drive shaft being adjustably mounted to the frame so as to be moveable between a first position at which the drive shaft has a first drive length, and at least a second position at which the drive shaft has a second drive length; the second drive length being greater than the first drive length.

7. The banding device of claim 3, wherein said banding assembly is pivotably mounted within the frame and moves from a first position for receiving an item to be banded and a second position for receiving the band from the transfer assembly.

8. The banding device of claim 3, includes a first banding mechanism for receiving a first band thereon, at least a second banding mechanism for receiving at least a second band thereon, the first banding mechanism and the at least second banding mechanism opening the first band and second band respectively such that the first band and second band are coaxial with each other when opened.

9. The banding device of claim 8, wherein the transfer assembly extends into the banding assembly to selectively place a band on the first banding mechanism and extends into the banding assembly to selectively place a second band on the at least second banding mechanism.

10. The banding device of claim 7, wherein said banding assembly is pivotably mounted within the frame and moves from a first position for receiving an item to be banded and a second position for receiving at least the first band from the transfer assembly.

11. The banding device of claim 3, wherein said banding assembly includes a first finger mechanism, a second finger mechanism, and an at least third finger mechanism, the first finger mechanism, second finger mechanism and at least third finger mechanism removing the band from the transfer assembly.

12. The banding device of claim 11, wherein the first finger mechanism, second finger mechanism and third finger mechanism are mounted on a support platform for removing the first band from the transfer assembly; and further comprising:

at least a second support platform, a fourth finger mechanism, fifth finger mechanism, and at least sixth finger mechanism for removing a second band from the transfer assembly, opening the band and being adapted to receive the item to be bundled and releasing the second band about the bundle, the first finger mechanism, second finger mechanism, and third finger mechanism opening the first band coaxially with the fourth finger mechanism, the fifth finger mechanism and six finger mechanism opening the second band.

13. The banding assembly of claim 3, further comprising a frame, the first banding mechanism and second banding mechanism being rotatably mounted within the frame.

14. A banding device comprising:

a frame;

a feeding assembly for feeding an elastic tubing into the frame;

a transfer assembly including a body is disposed within the frame, the transfer assembly having a pick up assembly, the pick up assembly having two or more fingers, the fingers adapted to receive the elastic tubing as fed from the feeding assembly;

a cutting assembly disposed between the transfer assembly and feeding assembly for cutting predetermined lengths of tubing into at least a band, at least one of the two or more fingers moveable between a first closed position for receiving the band and second open position for opening the band, and the body being moveable between a first position for receiving the band and a second position for transferring the band to a banding assembly, and the banding assembly for receiving the band from the transfer assembly at the second position and further opening the band, and adapted to receive an item to be bundled, and releasing the band about the item; and wherein the pick up assembly includes a rotatable head, the rotatable head rotating about an axis of rotation, the at least one finger being off set by an angle relative to an axis of rotation of the rotatable head.

15. A banding device comprising:

a frame;

a feeding assembly for feeding an elastic tubing into the frame;

a transfer assembly including a body is disposed within the frame, the transfer assembly having a pick up assembly, the pick up assembly having two or more fingers, the fingers adapted to receive the elastic tubing as fed from the feeding assembly;

a cutting assembly disposed between the transfer assembly and feeding assembly for cutting predetermined lengths of tubing into at least a band, at least one of the two or more fingers moveable between a first closed position for receiving the band and second open position for opening the band, and the body being moveable between a first position for receiving the band and a second position for transferring the band to a banding assembly, and the banding assembly for receiving the band from the transfer assembly at the second position and further opening the band, and adapted to receive an item to be bundled, and releasing the band about the item; and wherein the body includes a base, and a member slidingly affixed along the base to extend the length of the body, the two or more fingers being mounted to the member.

16. A banding device comprising:

a frame;

a feeding assembly for feeding an elastic tubing into the frame;

a transfer assembly including a body is disposed within the frame, the transfer assembly having a pick up assembly, the pick up assembly having two or more fingers, the fingers adapted to receive the elastic tubing as fed from the feeding assembly;

a cutting assembly disposed between the transfer assembly and feeding assembly for cutting predetermined lengths of tubing into at least a band, at least one of the two or more fingers moveable between a first closed position for receiving the band and second open position for opening the band, and the body being moveable between a first position for receiving the band and a second position for transferring the band to a banding assembly, and the banding assembly for receiving the band from the transfer assembly at the second position and further opening the band, and adapted to receive an item to be bundled, and releasing the band about the item; and a notch within at least one of the two or more fingers.

17. A banding assembly for banding a bundle of items, comprising:

a first banding mechanism having a first finger mechanism, a second finger mechanism and at least third finger mechanism, the first finger mechanism, second finger mechanism, and third finger mechanism, together receiving and opening a first band; and a second banding mechanism having a fourth finger mechanism, a fifth finger mechanism, and at least a sixth finger mechanism, the fourth finger mechanism, fifth finger mechanism, and at least sixth finger mechanism, receiving and opening a second band so that the second band is open coaxially with the first band and first banding mechanism releasing the first band and the second banding mechanism releasing the second band about an item to be bundled;

a rotatable member affixed to each of the respective one of said of first finger mechanism, second finger mechanism, at least third mechanism, fourth finger mechanism, fifth finger mechanism, and at least sixth finger mechanism; a respective peg extending from a respective rotatable member, the first band being engaged by a respective peg of the first finger mechanism, second finger mechanism, and at least third finger mechanism, and the second band being engaged by the peg of the at least fourth finger mechanism, fifth finger mechanism, and at least sixth finger mechanism; and a respective camming pin extending from a respective one of each rotatable member, the first finger mechanism, second finger mechanism, at least third finger mechanism, fourth finger mechanism, fifth finger mechanism, and at least sixth finger mechanism, each being movable between a first position for receiving the band and a second position for releasing the first band and second band about the item; and at least a first camming block, the at least first finger mechanism moving from the first position to second position to release the band when the camming pin of the first finger mechanism contacts the at least first camming block.

18. The banding mechanism of claim 17, wherein the mechanism releases the band by rotating the rotating head to move each peg from engaging the band.

19. The banding device of claim 15 wherein at least one of the two or more fingers is movable between a first position and second position relative to an axis of rotation of a rotation block.

* * * * *